US011851308B2

(12) United States Patent
Kim et al.

(10) Patent No.: US 11,851,308 B2
(45) Date of Patent: Dec. 26, 2023

(54) TELESCOPIC PIPE

(71) Applicants: Do Young Kim, Daejeon (KR); Yeong Ju Kim, Daejeon (KR); Yeong Min Kim, Daejeon (KR); Ju Eun Kim, Daejeon (KR)

(72) Inventors: Do Young Kim, Daejeon (KR); Yeong Ju Kim, Daejeon (KR); Yeong Min Kim, Daejeon (KR); Ju Eun Kim, Daejeon (KR)

( * ) Notice: Subject to any disclaimer, the term of this patent is extended or adjusted under 35 U.S.C. 154(b) by 177 days.

(21) Appl. No.: 17/606,106

(22) PCT Filed: Jan. 22, 2020

(86) PCT No.: PCT/KR2020/001140

§ 371 (c)(1),
(2) Date: Oct. 25, 2021

(87) PCT Pub. No.: WO2020/218718

PCT Pub. Date: Oct. 29, 2020

(65) Prior Publication Data

US 2022/0194760 A1 Jun. 23, 2022

(30) Foreign Application Priority Data

Apr. 23, 2019 (KR) ..... 10-2019-0047569

(51) Int. Cl.
*B66F 3/10* (2006.01)
*E04H 12/18* (2006.01)
(Continued)

(52) U.S. Cl.
CPC ..... *B66F 3/10* (2013.01); *E04H 12/182* (2013.01); *B66C 23/706* (2013.01); *B66F 3/44* (2013.01); *E06C 7/02* (2013.01)

(58) Field of Classification Search
CPC . B66F 3/10; B66F 3/44; E04H 12/182; B66C 23/706; B66C 23/701; E06C 7/02; E06C 7/06; F16L 37/2445
See application file for complete search history.

(56) References Cited

U.S. PATENT DOCUMENTS

2021/0370888 A1* 12/2021 Peacemaker ..... B66F 3/10

FOREIGN PATENT DOCUMENTS

CN 104319939 A * 1/2015
CN 104444861 A * 3/2015
(Continued)

OTHER PUBLICATIONS

English translation of the Written Opinion of the International Searching Authority (ISA/KR) for International Application No. PCT/KR2020/001140, dated May 22, 2020, 4 pages.
(Continued)

*Primary Examiner* — Mahdi H Nejad
(74) *Attorney, Agent, or Firm* — Ware, Fressola, Maguire & Barber LLP

(57) ABSTRACT

A telescopic pipe includes a base pipe having a base inner pipe rotated by external force, and a base outer pipe arranged to receive the base inner pipe; a connecting pipe having a connecting inner pipe coupled to the base inner pipe to be extendable to transfer rotational force, and a connecting outer pipe screw-coupled to the inner circumferential surface of the base outer pipe to be extendable; and a finishing pipe including a finishing inner pipe coupled to the connecting inner pipe to be extendable and to be rotated, and a finishing outer pipe that is interlocked by means of rotation of the finishing inner pipe and is screw-coupled to the inner circumferential surface of the connecting outer-pipe to be extendable, wherein the connecting outer pipe is interlocked
(Continued)

by the rotational force of the extended finishing outer pipe and thus is extended and retracted along the base outer pipe.

6 Claims, 13 Drawing Sheets

(51) Int. Cl.

| | |
|---|---|
| *B66C 23/70* | (2006.01) |
| *E06C 7/02* | (2006.01) |
| *B66F 3/44* | (2006.01) |

(56) References Cited

FOREIGN PATENT DOCUMENTS

| | | | | |
|---|---|---|---|---|
| CN | 110240081 | A | * | 9/2019 |
| DE | 102022130040 | A1 | * | 5/2023 |
| JP | 03-191184 | A | | 8/1991 |
| JP | 04-308604 | A | | 10/1992 |
| JP | 2753626 | B2 | | 5/1998 |
| KR | 10-1999-0035729 | A | | 5/1999 |
| KR | 10-2006-0118991 | A | | 11/2006 |
| KR | 20130001749 | | * | 1/2013 |
| KR | 20130001749 | A | * | 1/2013 |
| WO | WO 8404371 | A1 | * | 11/1984 |

OTHER PUBLICATIONS

English translation of the International Search Report (ISR) for International Application No. PCT/KR2020/001140, dated May 22, 2020, 2 pages.

* cited by examiner

TELESCOPIC PIPE

BACKGROUND

The present invention relates to a telescopic pipe of which the length can be increased or decreased, and more particularly, to a telescopic pipe which can extend and retract mechanical elements of high weight including a ladder of a fire engine or a boom of a crane in safety.

As generally known, a telescopic pipe is to adjust the length of the pipe by pushing a pipe into another pipe, and has been used as one of various mechanical elements, such as a cylinder or an antenna.

Korean Patent No. 1853000 (granted on Apr. 23, 2018) discloses a telescopic pipe.

The telescopic pipe of the conventional art extends the length of the pipe using a cylinder. If the conventional telescopic pipe is applied to a high weight machine including a ladder of a fire engine or a boom of a crane or is mounted at a high place, the conventional telescopic pipe cannot tolerate weight and climate, such as a typhoon, and may be easily broken.

SUMMARY

Accordingly, the present invention has been made in an effort to solve the above-mentioned problems occurring in the prior arts, and it is an object of the present invention to provide a telescopic pipe which can extend and retract mechanical elements of high weight including a ladder of a fire engine or a boom of a crane in safety and can secure safety even at a high place.

To achieve the above objects, the present invention provides a telescopic pipe which the length can be increased or decreased, the telescopic pipe including: a base pipe having a base inner pipe rotated by external force, and a base outer pipe arranged to receive the base inner pipe; a connecting pipe having a connecting inner pipe that is coupled to the base inner pipe to be extendable in order to transfer rotational force, and a connecting outer pipe that is screw-coupled to the inner circumferential surface of the base outer pipe to be extendable; and a finishing pipe including a finishing inner pipe that is coupled to the connecting inner pipe to be extendable and to be rotated, and a finishing outer pipe that is interlocked by means of rotation of the finishing inner pipe and is screw-coupled to the inner circumferential surface of the connecting outer pipe to be extendable, wherein the connecting outer pipe is interlocked by means of the rotational force of the extended finishing outer pipe and thus is extended and retracted along the base outer pipe.

In an embodiment of the present invention, the base inner pipe and the connecting inner pipe respectively have retaining jaws respectively formed on the inner surfaces of the outer end portions thereof, and the connecting inner pipe has tow rims formed on the inner surface thereof to be respectively locked to the retaining jaws.

In an embodiment of the present invention, the connecting outer pipe and the finishing outer pipe respectively have detents respectively formed on the inner lower portions thereof, and the base outer pipe and the connecting outer pipe respectively have notches respectively formed on the outer surface thereof to be respectively caught to the detents.

In an embodiment of the present invention, there are a plurality of the connecting pipes which have different diameters and are screw-coupled to be extendable.

In an embodiment or the present invention, the finishing pipe further includes a connecting member for connecting the outer end portions of the finishing inner pipe and the finishing outer pipe, and the connecting member includes a connection cover connected to finish outer end portions of the finishing inner pipe and the finishing outer pipe, and a fixing bolt for fixing the connection cover.

In another aspect of the present invention to achieve the above objects, the present invention provides a telescopic pipe of which the length can be increased or decreased, the telescopic pipe including: a base pipe including a base inner pipe which has a first male screw and is rotated by external driving power, and a base outer pipe which has a first female screw to be screw-coupled to the first male screw and is extendable according to the rotation of the base inner pipe; a connecting pipe which has a second male screw coupled to the base inner pipe to be extendable and to transfer rotational force, and a connecting outer pipe which has a second female screw to be screw-coupled to the second male screw and is extendable according to the rotation of the connecting inner pipe; and a finishing pipe which has a third male screw coupled to the connecting inner pipe to be extendable and to transfer rotational force, and a finishing outer pipe which has a third female screw to be screw-coupled to the third male screw and is extendable according to the rotation of the finishing inner pipe, wherein the base outer pipe, the connecting outer pipe, and the finishing outer pipe are extended and retracted at the same time according to the rotation of the base inner pipe, the connecting inner pipe, and the finishing inner pipe.

In an embodiment of the present invention, the base inner pipe and the connecting inner pipe respectively have stoppers respective formed on the inner surfaces of the outer end portions thereof, and the connecting inner pipe and the finishing inner pipe respectively have catches respectively formed on the outer surfaces of the inner end portions thereof to respectively lock the stoppers.

In an embodiment of the present invention, the base outer pipe, the connecting outer pipe, and the finishing outer pipe respective have stop rims respectively formed on the inner surfaces of the inner end portions thereof so as to be respectively locked to the male screws extended.

In an embodiment of the present invention, there are a plurality of the connecting pipes which have different diameters and are screw-coupled to be extendable.

The telescopic pipe according to an embodiment of the present invention can extend and retract mechanical elements of high weight including a ladder of a fire engine or a boom of a crane in safety and can secure safety even at a high place since pipes are extended and retracted in stages by screw-coupling.

The telescopic pipe according to another embodiment of the present invention can extend and retract a small-sized mechanical elements accurately since the pipes are extended and retracted at the same time by screw-coupling.

DETAILED DESCRIPTION

Figure 1:
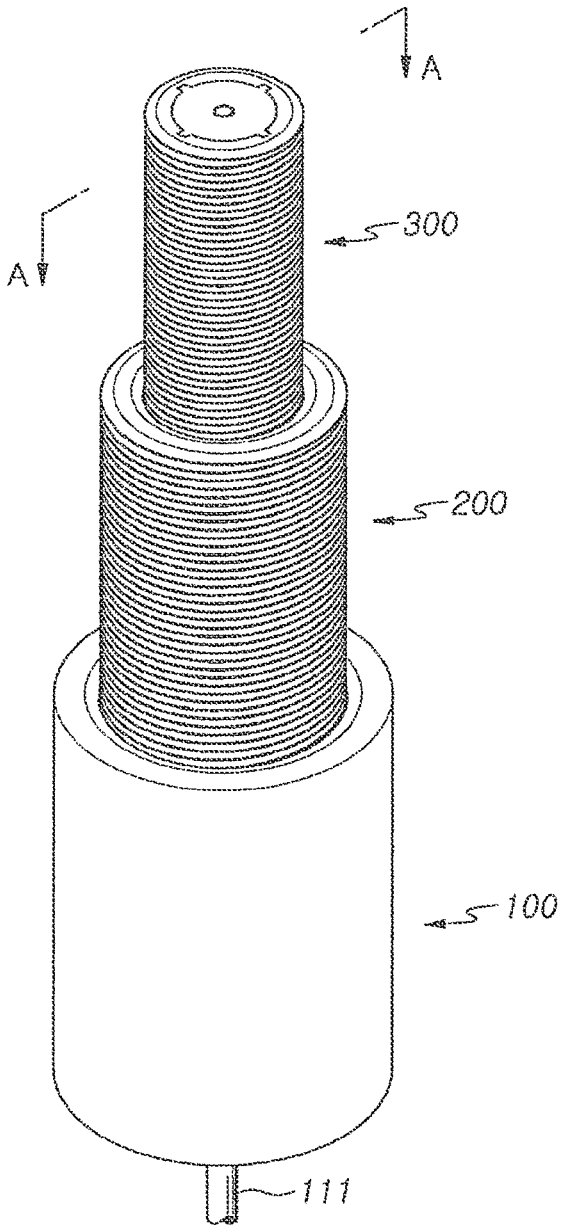
FIG. 1 is a perspective view illustrating an assembled state of a telescopic pipe according to a preferred embodiment of the present invention.

The present invention relates to a telescopic pipe which can extend and retract mechanical elements of high weight including a ladder of a fire engine or a boom of a crane in safety. The telescopic pipe of which the length can be increased or decreased includes: a base pipe having a base inner pipe rotated by external force, and a base outer pipe arranged to receive the base inner pipe; a connecting pipe having a connecting inner pipe that is coupled to the base inner pipe to be extendable in order to transfer rotational force, and a connecting outer pipe that is screw-coupled to the inner circumferential surface of the base outer pipe to be extendable; and a finishing pipe including a finishing inner pipe that is coupled to the connecting inner pipe to be extendable and to be rotated, and a finishing outer pipe that is interlocked by means of rotation of the finishing inner pipe and is screw-coupled to the inner circumferential surface of the connecting outer pipe to be extendable, wherein the connecting outer pipe is interlocked by means of the rotational force of the extended finishing outer pipe and thus is extended and retracted along the base outer pipe.

In order to fully understand the present invention, exemplary embodiments of the invention will be described with reference to the accompanying drawings. The embodiments of the present invention may be modified in many different forms and the scope of the invention should not be limited to the embodiments set forth herein. Rather, these embodiments are provided so that this disclosure will be thorough and complete, and will fully convey the concept of the invention to those skilled in the art. In the drawings, the shapes and dimensions may be exaggerated for clarity, and the same reference numerals will be used throughout to designate the same or like components. A detailed explanation of known related functions and constitutions may be omitted to avoid unnecessarily obscuring the subject matter of the present invention.

Hereinafter, preferred embodiments of the present invention will now be described in detail with reference to the attached drawings.

A telescopic pipe according to an embodiment of the present invention includes: a base pipe 100 having a base inner pipe 110 rotated by external force, and a base outer pipe 130 for receiving the base inner pipe; a connecting pipe 200 having a connecting inner pipe 210 that is coupled to the base inner pipe 110 to be extendable in order to transfer rotational force, and a connecting outer pipe 230 that, is screw-coupled to the inner circumferential surface of the base outer pipe 130 to be extendable; and a finishing pipe 300 including a finishing inner pipe 310 that is coupled to the connecting inner pipe 210 to be extendable and to be rotated, and a finishing outer pipe 330 that is interlocked by means of rotation of the finishing inner pipe 310 and is screw-coupled to the inner circumferential surface of the connecting outer pipe 230 to be extendable.

Figure 2:
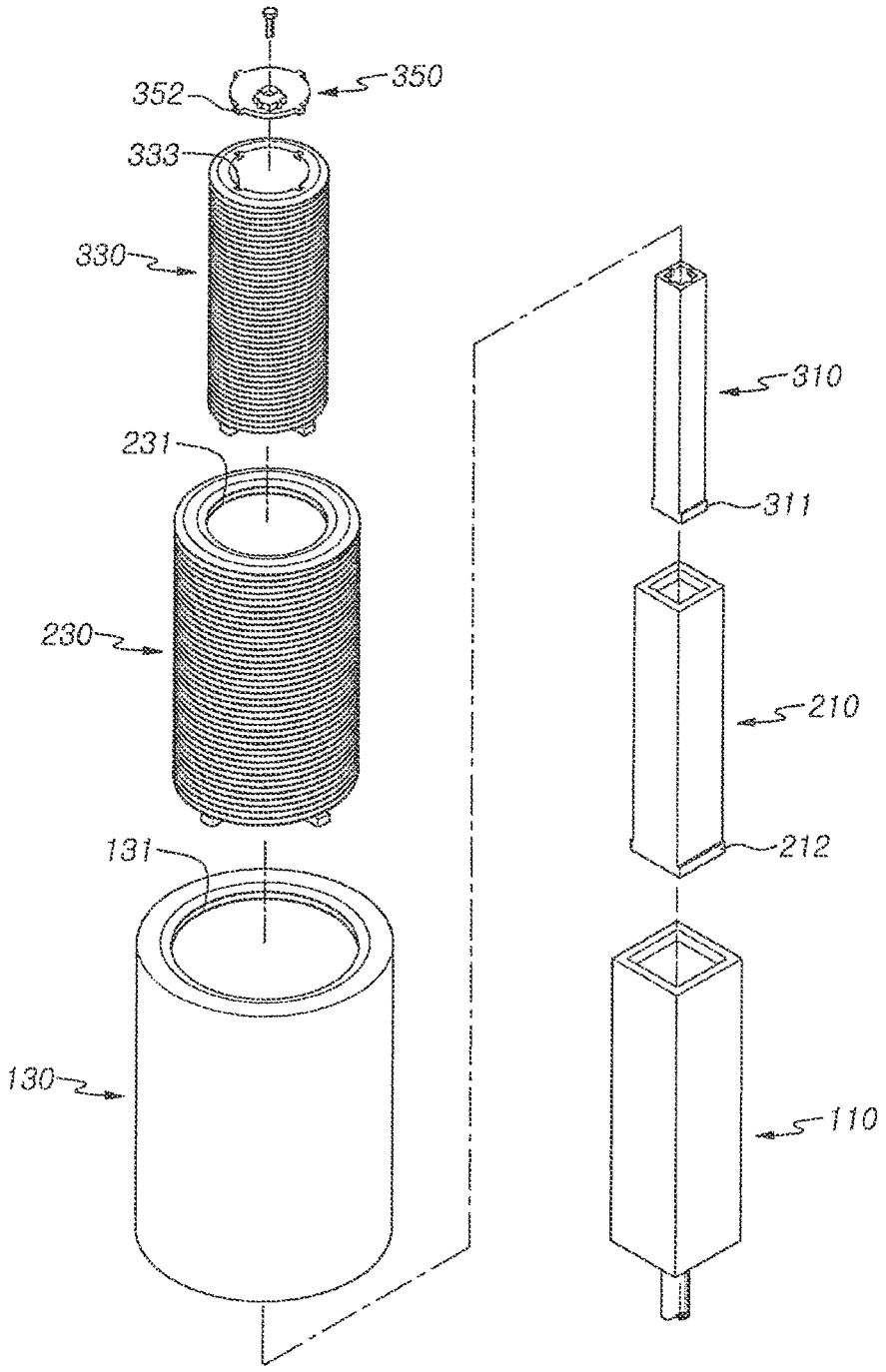
FIG. 2 is an exploded perspective view of the telescopic pipe according to a first embodiment of the present invention.

The base pipe 100 forms the basis of the present invention. As illustrated in FIGS. 1 and 2, the base pipe 100 includes the base inner pipe 110 of a square pipe shape and the base outer pipe 130 of a circular pipe shape.

Moreover, the base pipe 100 has an operational space S formed by a predetermined interval between the outer surface of the base inner pipe 110 and the inner surface of the base outer pipe 130 so as to prevent interference and to make the connecting outer pipe 230 and the finishing outer pipe 330 extended and retracted when the base inner pipe 110 is rotated.

Figure 3:
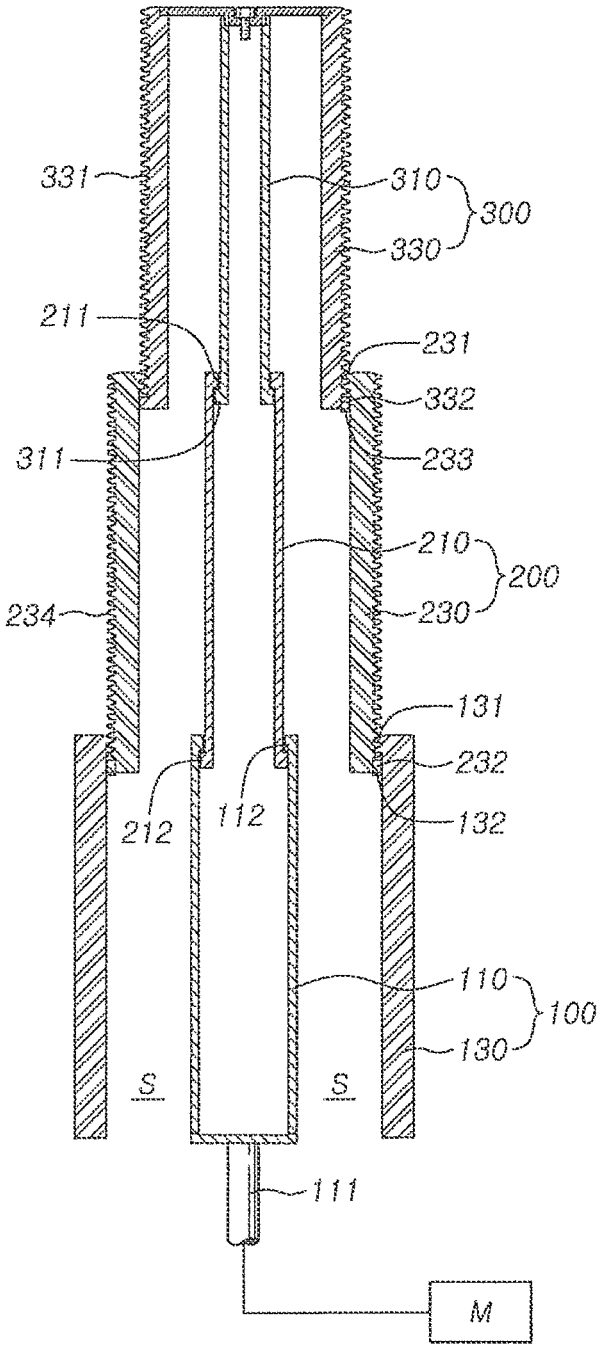
FIG. 3 is a sectional view taken along the line of A-A of FIG. 1.

A rotary shaft 111 is connected to the lower portion of the base inner pipe 110 so as to be rotated by external driving power, such as a motor M. Referring to FIG. 3, the base inner pipe 110 has first retaining jaws 112 disposed on the inner surface of an opened upper end thereof to lock second tow rims 212 of the connecting inner pipe 210 which will be described later. As illustrated in FIG. 2, preferably, the base inner pipe 110 is formed in an empty square pipe shape, but, if necessary, may be formed in a polygonal pipe shape, such as an octagonal pipe or a hexagonal pipe, of which the inside is empty to transfer rotational force by external driving power.

The base outer pipe 130 is formed in the empty circular pipe shape and has a first female screw 131 formed on the inner circumferential surface thereof. A second male screw 234 of the connecting outer pipe 230 which will be described later is screw-coupled to the first female screw 131 in order to guide extension and retraction of the connecting outer pipe 230. Here, preferably, the first female screw 131 is partially formed on the upper end of the inner surface of the base outer pipe 130, but, if necessary, the first female screw 131 may be generally formed on the inner surface of the base outer pipe 130. Referring to FIG. 3, the base outer pipe 130 has a first notch 132 formed on the upper portion of the inner surface thereof so that a second detent 232 of the connecting outer pipe 230 which will be described later can be caught to the first notch 132. The first notch 132 is formed to be adjacent to the lower end portion of the first female screw 131.

The connecting pipe 200 is to connect the base pipe 100 and the finishing pipe 300 with each other. As illustrated in FIGS. 1 and 2, the connecting pipe 200 includes: the connecting inner pipe 210 that is formed in a square pipe shape and is coupled to the base inner pipe 110 to be extendable into the base inner pipe 110; and the connecting outer pipe 230 that is formed in a circular pipe shape and is screw-coupled to the inner surface of the base outer pipe 130 to be extendable.

Referring to FIGS. 2 and 3, the connecting inner pipe 210 is formed in a square pipe shape to correspond to the shape of the base inner pipe 110 and coupled to the inner surface of the base inner pipe 110 to be extendable. The second tow rims 212 protrude from both sides of the lower portion of the outer surface of the connecting inner pipe 210 and is caught to the first retaining jaws 112 of the base inner pipe 110. The connecting inner pipe 210 has second retaining jaws 211 disposed at the upper end portion of the inner surface thereof in order to lock third tow rims 311 of the finishing inner pipe 310 which will be described later.

The connecting outer pipe 230 is formed in an empty circular pipe shape and has a second female screw 231 formed on the inner circumferential surface thereof and a second male screw 234 formed on the outer circumferential surface thereof. The second female screw 231 is screw-coupled with a third male screw 331 of the finishing outer pipe 330 which will be described later, and the second male screw 234 is screw-coupled with the first female screw 131 of the base outer pipe 130. Here, preferably, the second female screw 231 is partially formed on the upper end of the inner surface of the connecting outer pipe 230, but, if necessary, the second female screw 231 may be generally formed on the inner surface of the connecting outer pipe 230. Referring to FIG. 3, the connecting outer pipe 230 has the second detent 232 formed at the lower portion of the outer surface thereof to be caught to the first, notch 132 of the base outer pipe 130.

Especially, there may be a plurality of the connecting pipes 200 which have different diameters and are connected to be extendable. For instance, a plurality of the connecting inner pipes 210 of which the diameter is decreased gradually are connected to be extendable, and a plurality of the connecting outer pipes 230 of which the diameter is decreased gradually are screw-coupled to be extendable, so that the connecting pipes 200 can elongate between the base pipe 100 and the finishing pipe 300.

The finishing pipe 300 forms the end part of the present invention. As illustrated in FIGS. 1 and 2, the finishing pipe 300 includes: the finishing inner pipe 310 that is formed in a square pipe shape and is coupled to the inner surface of the connecting inner pipe 210 to be extendable; and a finishing outer pipe 330 that is formed in a circular pipe shape and is screw-coupled to the inner surface of the connecting outer pipe 230 to be extendable; and a connecting member 350 for connecting the outer end portions of the finishing inner pipe 310 and the finishing outer pipe 330.

Referring to FIGS. 2 and 3, as described above, the finishing inner pipe 310 is formed in the square pipe to correspond to the shape of the connecting inner pipe 210 and is coupled to the inner surface of the connecting inner pipe 210 to be extendable. The finishing inner pipe 310 has third tow rims 311 protruding from both sides of the lower portion of the outer surface thereof. The third tow rims 311 are caught to the second retaining jaws 211 of the connecting inner pipe 210. The upper portion of the finishing inner pipe 310 is shielded and the finishing inner pipe 310 has a coupling groove formed on the upper surface thereof.

The finishing outer pipe 330 is formed in an empty circular pipe shape and has the third male screw 331 formed on the outer circumferential surface thereof. The third male screw 331 is screw-coupled with the second female screw 231 of the connecting outer pipe 230 to guide extension and retraction of the finishing outer pipe 330. The finishing outer pipe 330 has key seats 333 formed at the upper end portion of the inner circumferential surface thereof so that coupling keys 352 of the connecting member 350 which will be described later are coupled with the key seats. Referring to FIG. 3, a third detent 332 is formed on the lower portion of the outer surface of the finishing outer pipe 330 so as to be caught to a second notch 233 of the connecting outer pipe 230.

The connecting member 350 connects the finishing inner pipe 310 and the finishing outer pipe 330 with each other so as to rotate the finishing outer pipe 330 simultaneously according to the rotation of the finishing inner pipe 310. The connecting member 350 includes a connection cover 351 connected to finish outer end portions of the finishing inner pipe 310 and the finishing outer pipe 330, and a fixing bolt 354 for fixing the connection cover 351.

Figure 4:
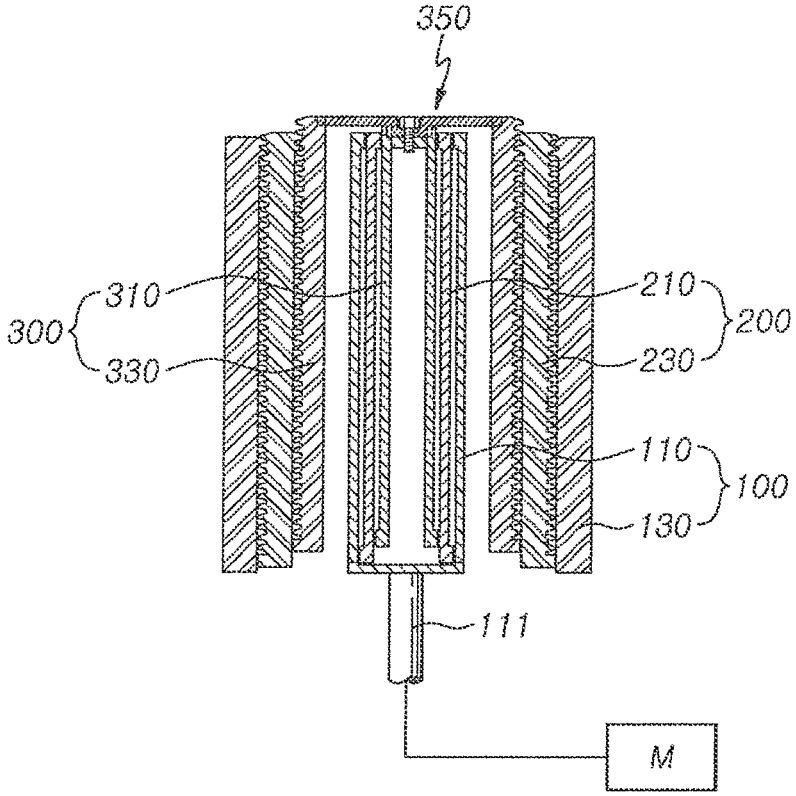
FIG. 4 is a sectional view illustrating a state where individual pipes according to the embodiment of the present invention are retracted.
Figure 5:
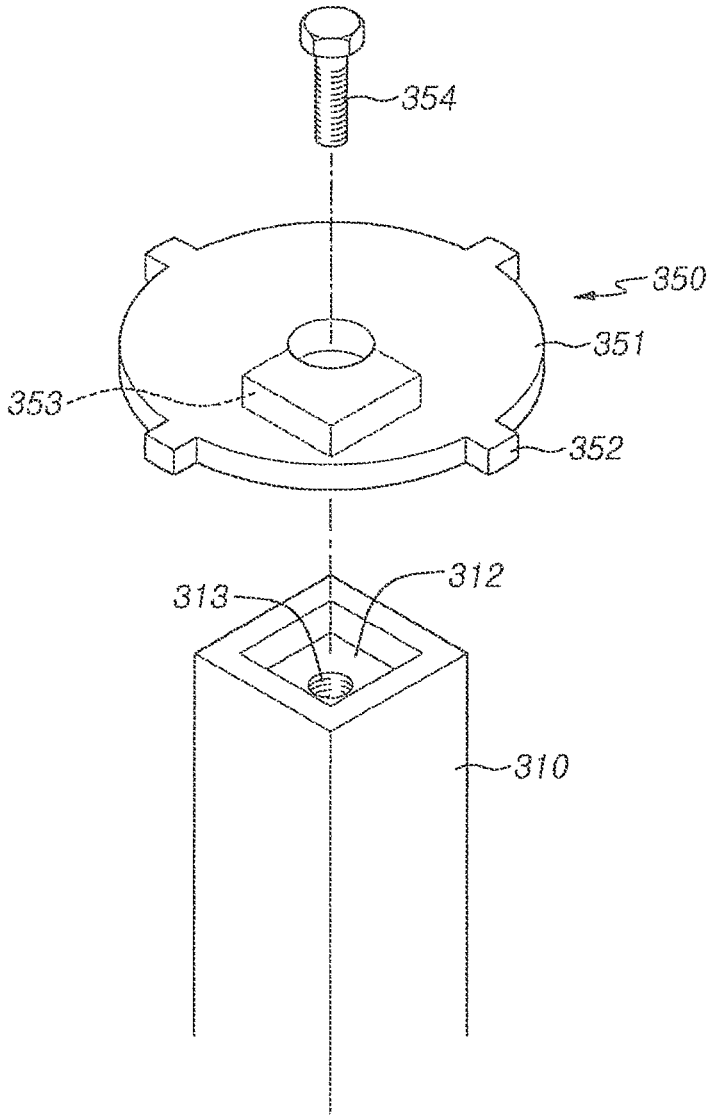
FIG. 5 is an exploded perspective view of a finishing inner pipe and a connecting member according to the embodiment of the present invention.

Referring to FIG. 4, the connection cover 351 is formed in an approximately disk shape and has a counterbore formed in the middle of the upper surface thereof. The connection cover 351 has one or more coupling keys 352 disposed on the circumference thereof to be key-coupled to the key seats 333 of the finishing outer pipe 330. The connection cover 351 has a coupling binding part 353 disposed on the bottom surface thereof to be forcibly fit to a coupling recess 312 of the finishing inner pipe 310. Here, the coupling binding part 353 is formed in a polygonal shape corresponding to the shape of the coupling recess 312 of the finishing inner pipe 310 so that the rotational force of the finishing inner pipe 310 is transferred to the connection cover 351 as it is.

The fixing bolt 354 penetrates through the counterbore of the connection cover 351 and is screw-coupled with a tap hole 313 of the finishing inner pipe 310 so as to fix the connection cover 351 to the finishing inner pipe 310. In this instance, because the inner end portion of the finishing outer pipe 330 is screw-coupled to the connecting outer pipe 230, there is no need to fix the connection cover 351 and the finishing outer pipe 330 using bolts.

Now, referring to the attached drawings, the general operation relationship of the telescopic pipe according to the embodiment of the present invention will be described in detail.

First, when the base inner pipe 110 rotates around the rotary shaft 111 by external driving power, the connecting inner pipe 210 and the finishing inner pipe 310 are rotated at the same time.

Next, the rotational force of the finishing inner pipe 310 is transferred to the finishing outer pipe 330 as it is through the connecting member 350 so that the finishing inner pipe 310 and the finishing outer pipe 330 are rotated at the same time. The finishing outer pipe 330 is guided by the second female screw 231 of the connecting outer pipe 230 so as to be extended while rotating as illustrated in FIG. 2.

Figure 6:
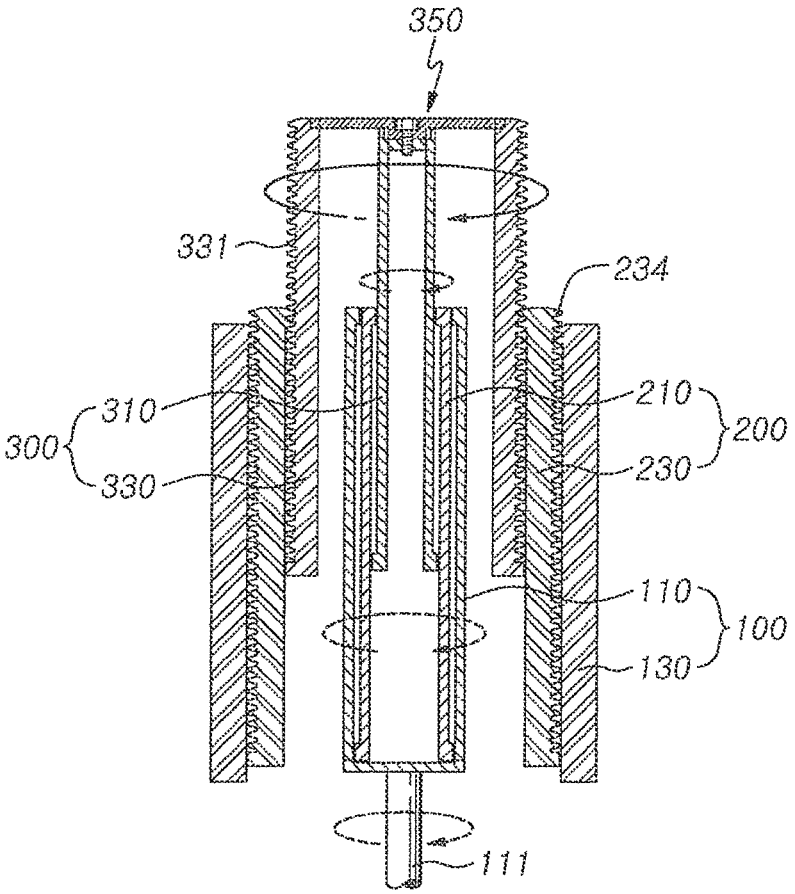
FIGS. 6 to 9 are views illustrating the operation of the telescopic pipe according to the embodiment of the present invention.
Figure 7:
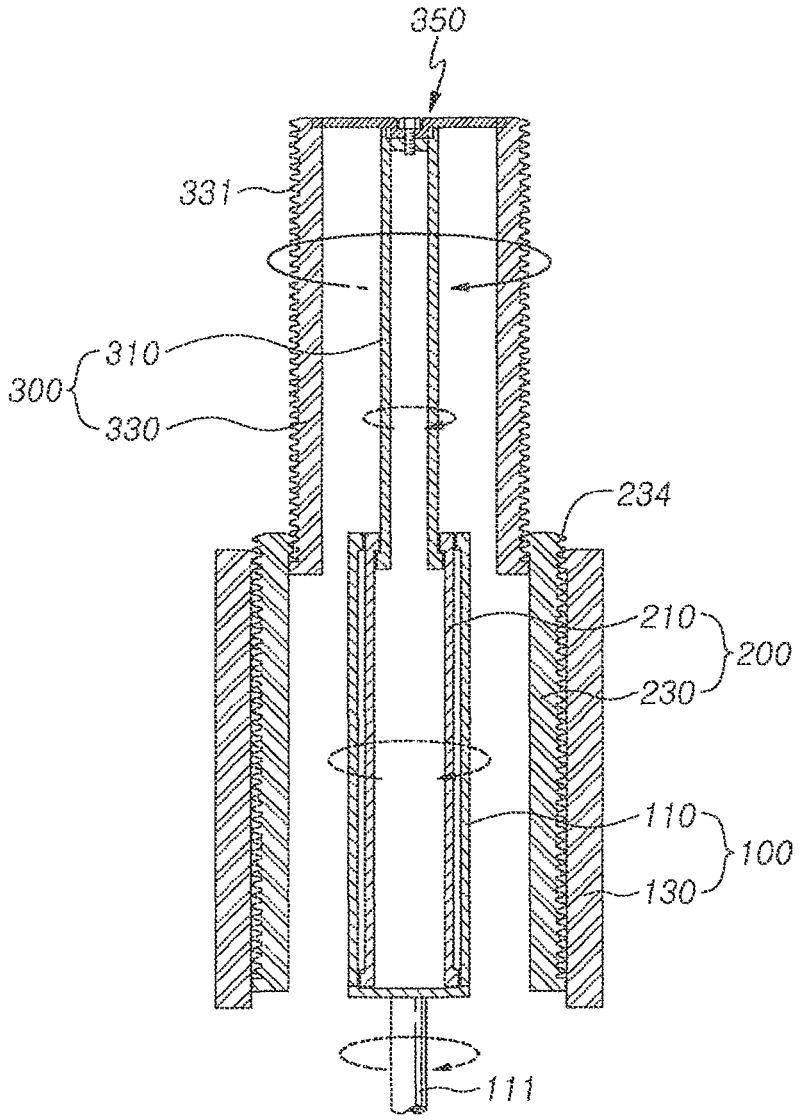
Figure 8:
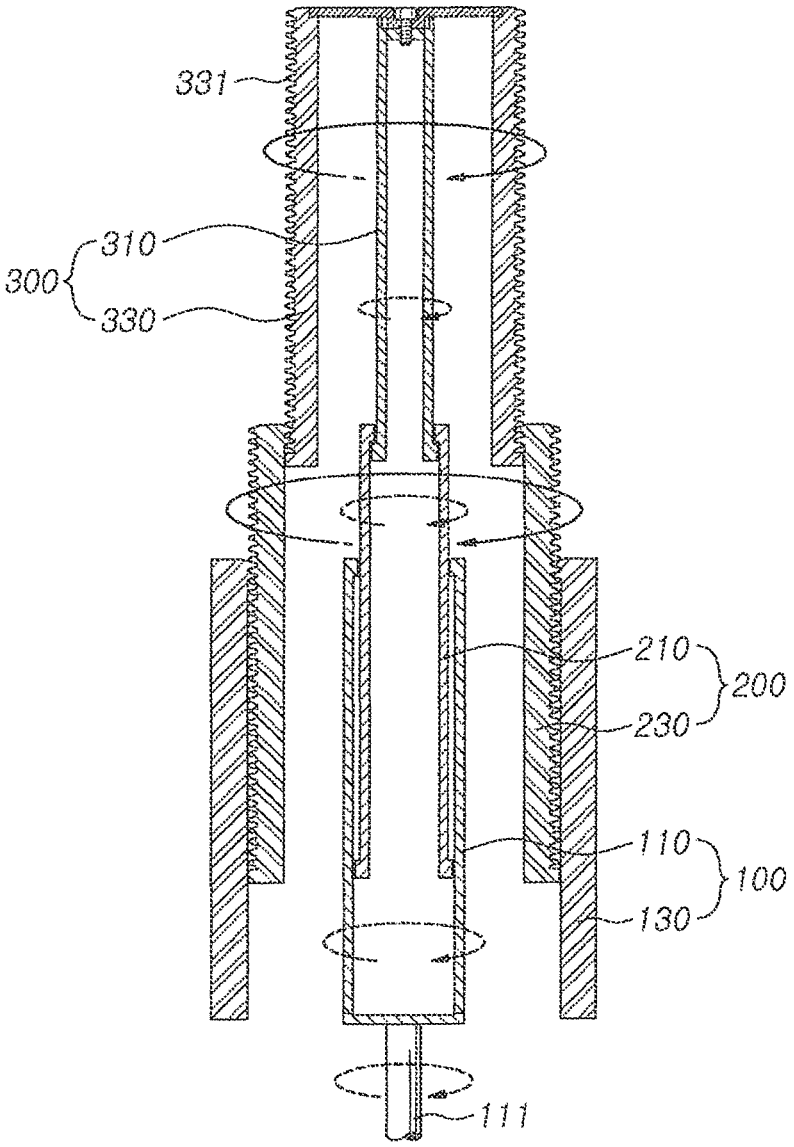

For your reference, the dotted arrows illustrated in FIGS. 6 to 8 indicate rotational states and directions of the base inner pipe 110, the connecting inner pipe 210, and the finishing inner pipe 310, and the solid line arrows indicate rotational states and directions of the connecting outer pipe 230 and the finishing outer pipe 330.

Next, as illustrated in FIG. 7, when the third detent 332 is locked to the second notch 233 of the connecting outer pipe 230 by the rotation of the finishing outer pipe 330, the extended distance of the finishing outer pipe 330 is at the maximum value.

Continuously, because the rotational force of the finishing outer pipe 330 is transferred to the connecting outer pipe 230 by the third detent 332 locked to the second notch 233, as illustrated in FIG. 8, the connecting outer pipe 230 and the finishing outer pipe 330 are rotated together.

In this instance, because the second retaining jaw 211 of the connecting inner pipe 210 is caught to the third tow rim 311 of the finishing inner pipe 310, the connecting outer pipe 230 is towed by the finishing inner pipe 310 to be extended.

Figure 9:
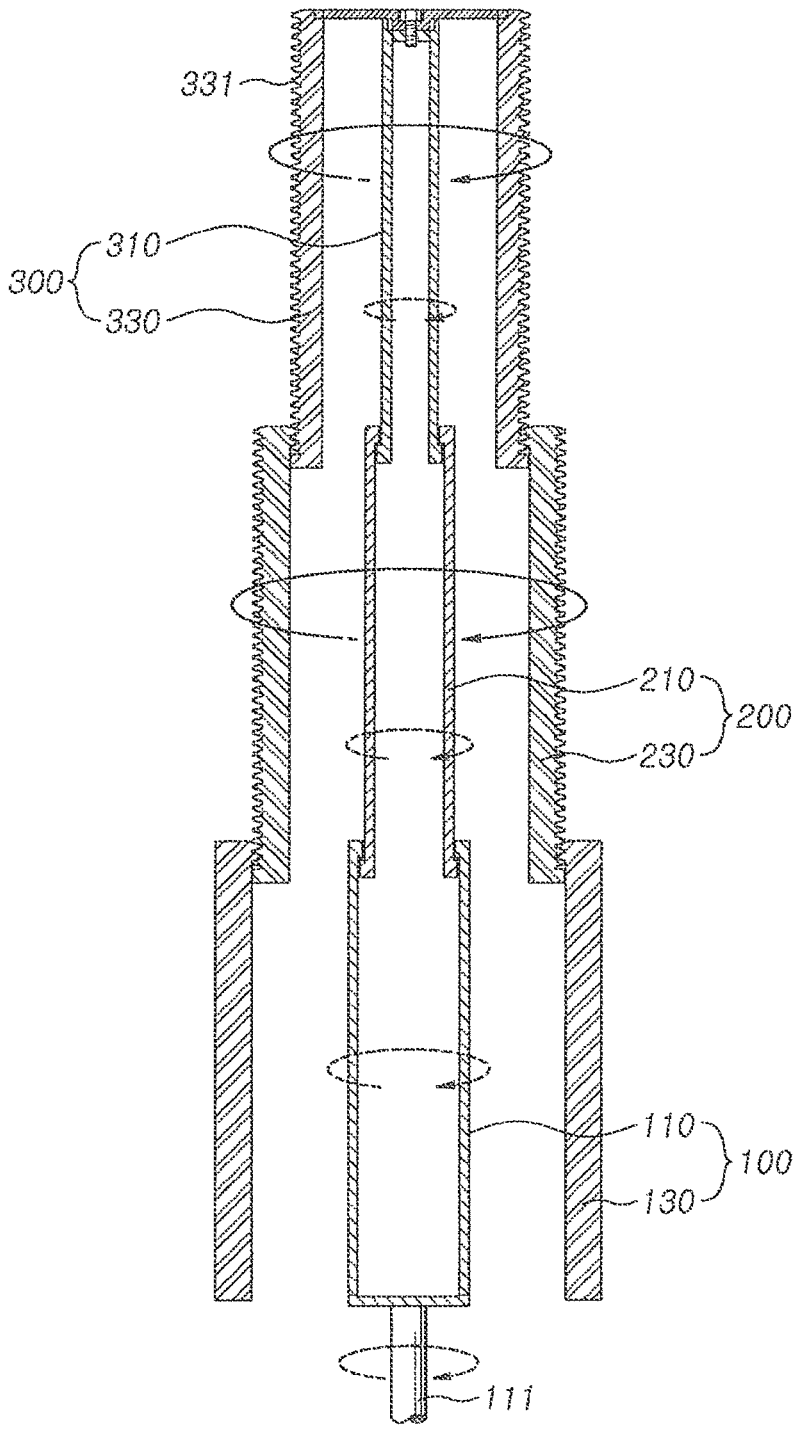

Finally, as illustrated in FIG. 9, when the second decent 232 is locked to the first notch 132 of the base outer pipe 130 by the rotation of the connecting outer pipe 230, the extended distance of the connecting outer pipe is at the maximum value.

Meanwhile, a detailed description of the operational relationship that the telescopic pipe is retracted will be omitted, since the operational relationship that the telescopic pipe is retracted is carried in reverse order of the operational relationship that the telescopic pipe is extended.

However, the rotary shaft 111 is rotated in the opposite direction by the external driving power. After the rotation of the finishing outer pipe 330 is finished, the connecting outer pipe 230 is rotated. As illustrated in FIG. 4, when the telescopic pipe is retracted completely, the finishing inner pipe 310 and the connecting inner pipe 210 are locked to the bottom surface of the base inner pipe 110 so as not to be retracted any more.

Meanwhile, FIGS. 10 to 13 are views illustrating a telescopic pipe according to another embodiment of the present invention. Hereinafter, referring to the attached drawing, the telescopic pipe according to another embodiment of the present invention will be described in detail.

The telescopic pipe according to the second embodiment of the present invention includes: a base pipe 400 including a base inner pipe 410 which has a first male screw 412 and is rotated by external driving power, and a base outer pipe 430 which has a first female screw 431 to be screw-coupled to the first male screw 412 and is extendable according to the rotation of the base inner pipe 410; a connecting pipe 500 which has a second male screw 512 coupled to the base inner pipe 410 to be extendable and to transfer rotational force, and a connecting outer pipe 530 which has a second female screw 531 to be screw-coupled to the second male screw 512 and is extendable according to the rotation of the connecting inner pipe 510; and a finishing pipe 600 which has a third male screw 612 coupled to the connecting inner pipe 510 to be extendable and to transfer rotational force, and a finishing outer pipe 630 which has a third female screw 631 to be screw-coupled to the third male screw 612 and is extendable according to the rotation of the finishing inner pipe 610.

The base pipe 400 forms the basis of the present invention, and the base pipe 400 includes the base inner pipe 410 of a square pipe shape having the first male screw 412, and the base outer pipe 430 of a circular pipe shape having the first female screw 431.

Moreover, the base pipe 400 has an operational space S formed by a predetermined interval between the outer surface of the base inner pipe 410 and the inner surface of the base outer pipe 430 so as to prevent interference.

Figure 10:
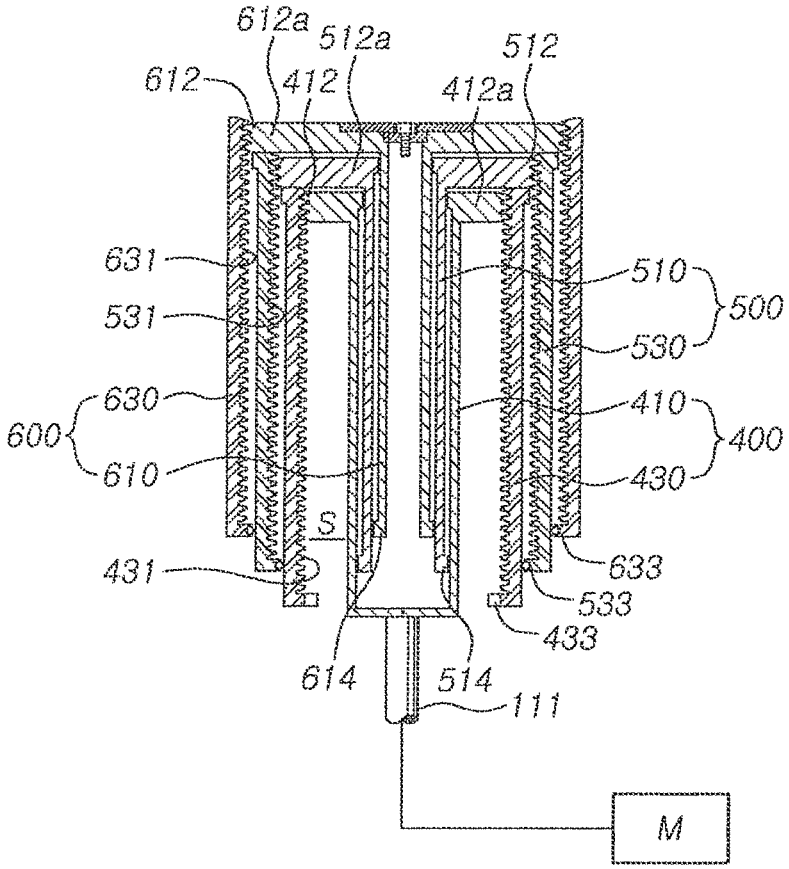
FIG. 10 is a sectional view illustrating a state individual pipes according to a second embodiment of the present invention are retracted.

A rotary shaft 411 is connected to the lower portion of the base inner pipe 410 so as to be rotated by external driving power, such as a motor M. Referring to FIG. 10, the base inner pipe 410 has a first stopper 413 disposed on the inner surface of an opened upper end thereof to lock a second catch of the connecting inner pipe 510. Preferably, the base inner pipe 410 is formed in an empty square pipe shape, but, if necessary, may be formed in a polygonal pipe shape, such as an octagonal pipe or a hexagonal pipe, of which the inside is empty to transfer rotational force by external driving power. The first male screw 412 is disposed integrally on the outer circumferential surface of the base inner pipe 410. As illustrated in FIG. 10, the first male screw 412 is formed on a first boss 412*a*, which protrudes thick from the upper end of the outer circumferential surface of the base inner pipe 410.

The base outer pipe 430 is formed in the empty circular pipe shape and has the first female screw 431 formed on the inner circumferential surface thereof. Because the first male screw 412 of the base inner pipe 410 is screw-coupled to the first female screw 431, the base outer pipe is extended by the rotation of the base inner pipe 410. The base outer pipe 430 has a first gusset 432 formed on the upper end of the outer surface thereof so as to lock a second stop rim 533 of the connecting outer pipe 530 which will be described later, and has a first stop rim 433 formed on the lower end of the inner circumferential surface thereof so as to be locked to the first male screw 412 of the base inner pipe 410.

The connecting pipe 500 is to connect the base pipe 400 and the finishing pipe 600 with each other. The connecting pipe 500 includes the connecting inner pipe 510 of a square pipe shape having the second male screw 512, and the connecting outer pipe 530 of a circular pipe shape having the second female screw 531.

The connecting inner pipe 510 is formed in a square pipe shape to correspond to the shape of the base inner pipe 410 and is coupled to the inner surface of the base inner pipe 410 to be extendable. The second male screw 512 is disposed integrally with the outer circumferential surface of the connecting inner pipe 510. As illustrated in FIG. 10, the second male screw 512 is formed on a second boss 512*a*, which protrudes thick from the upper end of the outer circumferential surface of the connecting inner pipe 510. The connecting inner pipe 510 has a second stopper 513 disposed on the upper end of the inner surface so as to lock a third catch 614 of the finishing inner pipe 610 which will be described later, and a second catch 514 disposed on the lower end of the outer surface so as to lock the first stopper 413 of the base inner pipe 410.

The connecting outer pipe 530 is formed in an empty circular pipe shape and has the second female screw 531 disposed on the inner circumferential surface thereof. Because the second male screw 512 of the connecting inner pipe 510 is screw-coupled to the second female screw 531, the connecting outer pipe is extended and retracted by the rotation of the connecting inner pipe 510. The connecting outer pipe 530 has a second gusset 532 formed on the upper end of the outer circumferential surface thereof so as to lock a third stop rim 633 of the finishing outer pipe 630 which will be described later, and the second stop rim 533 formed on the lower end of the inner circumferential surface so as to lock the second male screw 512 of the connecting inner pipe 510.

Especially, there may be a plurality of the connecting pipes 500 which have different diameters and are connected to be extendable. For instance, a plurality of the connecting inner pipes 510 of which the diameter is decreased gradually are connected to be extendable, and a plurality of the connecting outer pipes 530 of which the diameter is increased gradually are screw-coupled to be extendable, so that the connecting pipes 500 can elongate between the base pipe 400 and the finishing pipe 600.

The finishing pipe 600 forms the end part of the present invention. The finishing pipe 600 includes: the finishing inner pipe 610 that has the third male screw 612 and is coupled to the inner surface of the connecting inner pipe 510 to be extendable; the finishing outer pipe 630 that has the third female screw 631 and is coupled to the outer surface of the connecting outer pipe 530 to be extendable; and a connecting member 650 for connecting outer end portions of the finishing inner pipe 610 and the finishing outer pipe 630.

The finishing inner pipe 610 is formed in a square pipe shape to correspond to the shape of the connecting inner pipe 510 and is coupled to the inner surface of the connecting inner pipe 510 to be extendable. The third male screw 612 is disposed integrally with the outer circumferential surface of the finishing inner pipe 610. As illustrated in FIG. 10, the third male screw 612 is formed on a third boss 612*a* protruding thick from the upper end of the outer circumferential surface of the finishing inner pipe 610. The finishing inner pipe 610 has the third catch 614 formed on the lower end of the outer surface thereof so as to be locked to the second stopper 513 of the connecting inner pipe 510.

The finishing outer pipe 630 is formed in an empty circular pipe shape and has the third female screw 631 disposed on the inner circumferential surface thereof. The third male screw 612 of the finishing outer pipe 630 is screw-coupled to the third female screw 631 so that the finishing outer pipe 630 is extended and retracted while rotating along the finishing inner pipe 610. The finishing outer pipe 630 has the third stop rim 633 formed on the lower end of the inner surface thereof so as to be locked to the third male screw 612 of the finishing inner pipe 610.

Now, referring to the attached drawings, the general operational relationship of the telescopic pipe according to the second embodiment of the present invention will be described in detail.

First, when the base inner pipe 410 rotates around the rotary shaft 411 by external driving power, the connecting inner pipe 510 and the finishing inner pipe 610 are rotated at the same time.

Figure 11:
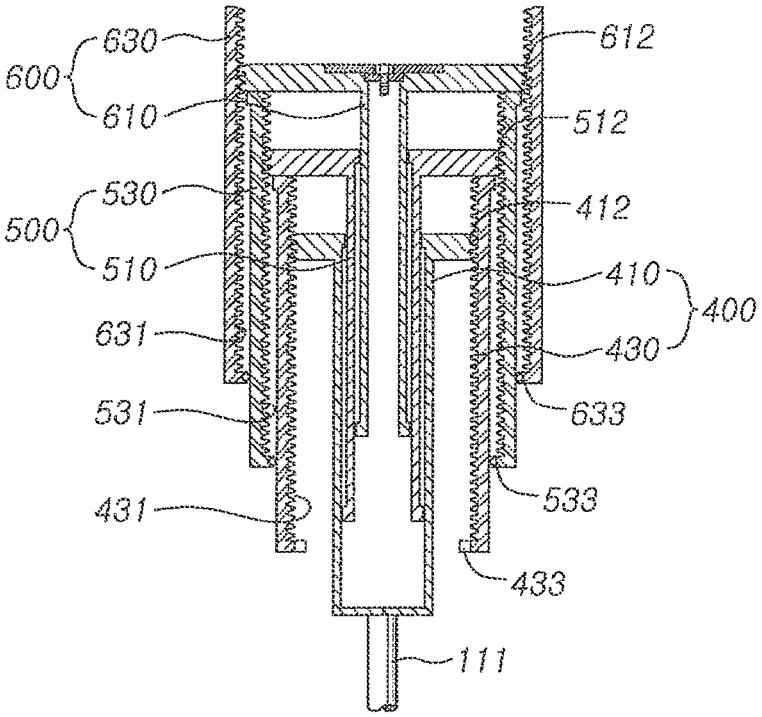
FIGS. 11 to 13 are views illustrating the operation of the telescopic pipe according to the second embodiment of the present invention.
Figure 12:
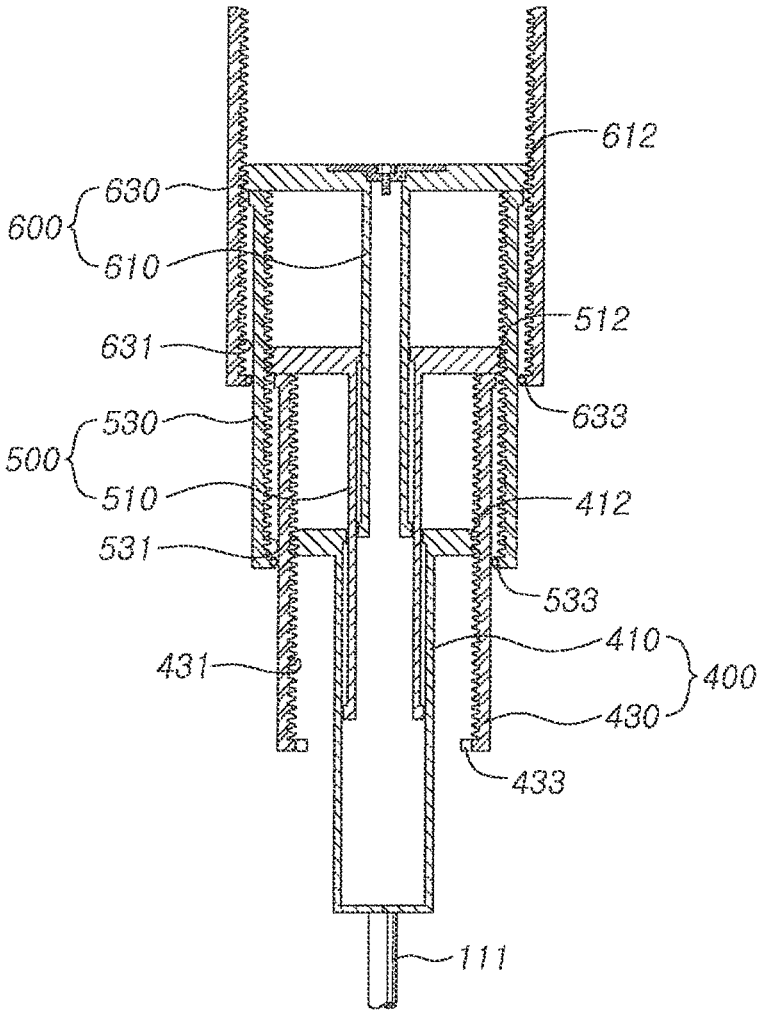

In this instance, the first to third male screws 412, 512 and 612 are rotated, the base outer pipe 430, the connecting outer pipe 530 and the finishing outer pipe 630 are simultaneously rotated by the first to third female screws 431, 531 and 631, which are respectively screw-coupled to the male screws, so as to be extended along the inner pipes thereof as illustrated in FIGS. 11 and 12.

Figure 13:
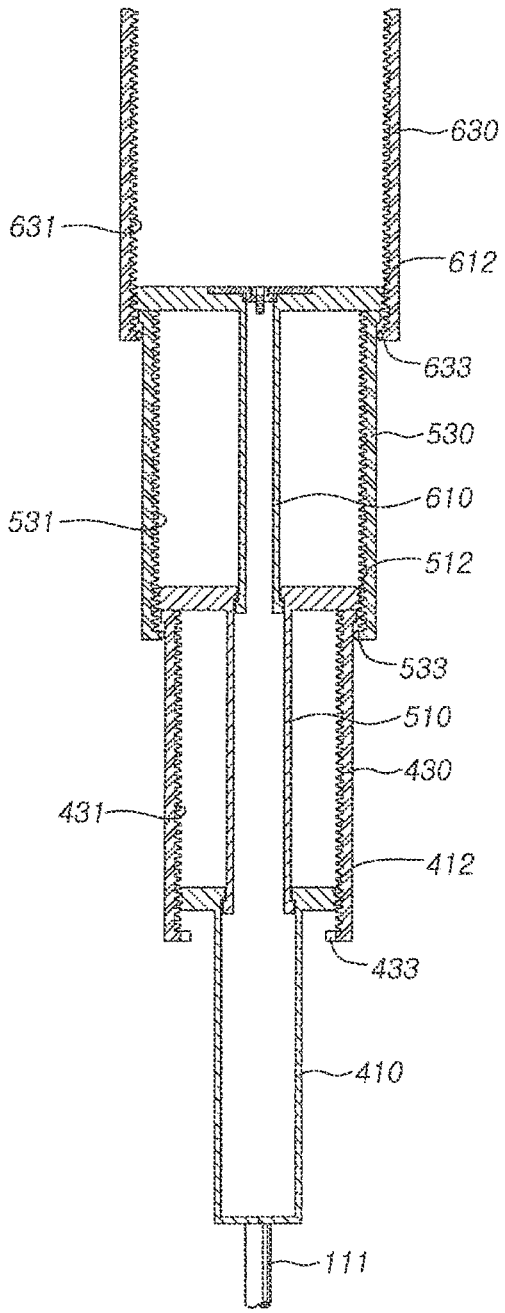

Next, as illustrated in FIG. 13, when the first to third stop rims 433, 533 and 633 are respectively locked to the male screws and the second catch 514 and the third catch 614 are respectively locked to the stoppers, the extended distances of the base pipe 400, the connecting pipe 500, and the finishing pipe 600 are respectively at the maximum values.

Meanwhile, a detailed description of the operational relationship that the telescopic pipe is retracted will be omitted, since the operational relationship that the telescopic pipe is retracted is carried in reverse order of the operational relationship that the telescopic pipe is extended. However, the rotary shaft 411 is rotated in the opposite direction by the external driving power.

The embodiments of the present invention as described above are only the example. Therefore, it will be appreciated by those skilled in the art that various modifications and equivalent other embodiments are possible from the present invention.

Therefore, it may be appreciated that the present invention is not limited to the forms mentioned in the above detailed description.

Accordingly, the actual technical protection scope of the present invention must be determined by the spirit of the appended claims. Further, it is to be construed that the present invention includes all the changes, equivalents, and substitutions which are defined is the appending claims.

As described above, the present invention can provide a telescopic pipe which can extend and retract mechanical elements of high weight including a ladder of a fire engine or a boom of a crane in safety and can secure safety even at a high place.

The invention claimed is:

1. A telescopic pipe of which the length can be increased or decreased, the telescopic pipe comprising:

a base pipe having a base inner pipe rotated by external force, and a base outer pipe arranged to receive the base inner pipe;

a connecting pipe having a connecting inner pipe that is coupled to the base inner pipe to be extendable in order to transfer rotational force, and a connecting outer pipe that is screw-coupled to an inner circumferential surface of the base outer pipe to be extendable; and a finishing pipe including a finishing inner pipe that is coupled to the connecting inner pipe to be extendable and to be rotated, and a finishing outer pipe that is interlocked by means of rotation of the finishing inner pipe and is screw-coupled to an inner circumferential surface of the connecting outer pipe to be extendable, wherein the connecting outer pipe is interlocked by means of the rotational force of the extended finishing outer pipe and thus is extended and retracted along the base outer pipe, wherein the base inner pipe and the connecting inner pipe respectively have retaining jaws respectively formed on inner surfaces of outer end portions thereof, and the connecting inner pipe has tow rims formed on an inner surface thereof to be respectively locked to the retaining jaws.

2. The telescopic pipe according to claim 1, wherein there are a plurality of the connecting pipes which have different diameters and are screw-coupled to be extendable.

3. The telescopic pipe according to claim 1, wherein the finishing pipe further includes a connecting member for connecting outer end portions of the finishing inner pipe and the finishing outer pipe, and wherein the connecting member includes a connection cover connected to finish outer end portions of the finishing inner pipe and the finishing outer pipe, and a fixing bolt for fixing the connection cover.

4. A telescopic pipe of which the length can be increased or decreased, the telescopic pipe comprising:

a base pipe having a base inner pipe rotated by external force, and a base outer pipe arranged to receive the base inner pipe;

a connecting pipe having a connecting inner pipe that is coupled to the base inner pipe to be extendable in order to transfer rotational force, and a connecting outer pipe that is screw-coupled to an inner circumferential surface of the base outer pipe to be extendable; and a finishing pipe including a finishing inner pipe that is coupled to the connecting inner pipe to be extendable and to be rotated, and a finishing outer pipe that is interlocked by means of rotation of the finishing inner pipe and is screw-coupled to an inner circumferential surface of the connecting outer pipe to be extendable, wherein the connecting outer pipe is interlocked by means of the rotational force of the extended finishing outer pipe and thus is extended and retracted along the base outer pipe, wherein the connecting outer pipe and the finishing outer pipe respectively have detents respectively formed on inner lower portions thereof, and the base outer pipe and the connecting outer pipe respectively have notches respectively formed on an outer surface thereof to be respectively caught to the detents.

5. The telescopic pipe according to claim 4, wherein there are a plurality of the connecting pipes which have different diameters and are screw-coupled to be extendable.

6. The telescopic pipe according to claim 4, wherein the finishing pipe further includes a connecting member for connecting outer end portions of the finishing inner pipe and the finishing outer pipe, and wherein the connecting member includes a connection cover connected to finish outer end portions of the finishing inner pipe and the finishing outer pipe, and a fixing bolt for fixing the connection cover.

* * * * *